United States Patent [19]

Rohner et al.

[11] Patent Number: 4,468,918

[45] Date of Patent: Sep. 4, 1984

[54] COMPRESSED GAS SPLICING HEAD

[75] Inventors: Joachim Rohner; Heinz Zumfeld; Reinhard Mauries, all of Mönchengladbach, Fed. Rep. of Germany

[73] Assignee: W. Schlafhorst & Co., Moenchengladbach, Fed. Rep. of Germany

[21] Appl. No.: 488,104

[22] Filed: Apr. 25, 1983

[30] Foreign Application Priority Data

Apr. 24, 1982 [DE] Fed. Rep. of Germany ..... 3215423

[51] Int. Cl.[3] ..... B65H 69/06; D01H 15/00; D02J 1/08

[52] U.S. Cl. ..... 57/22; 57/333

[58] Field of Search ..... 57/22, 23, 202, 261, 57/333, 350; 28/271–276

[56] References Cited

U.S. PATENT DOCUMENTS

| | | | |
|---|---|---|---|
| 4,002,012 | 1/1977 | Norris et al. | 57/22 |
| 4,121,409 | 10/1978 | Uchida et al. | 57/22 |
| 4,217,749 | 8/1980 | Rohner et al. | 57/261 |
| 4,232,509 | 11/1980 | Rohner et al. | 57/261 |
| 4,322,943 | 4/1982 | Rohner et al. | 57/261 |
| 4,419,858 | 12/1983 | Rohner et al. | 57/22 |
| 4,424,663 | 1/1984 | Rohner et al. | 57/22 |

*Primary Examiner*—John Petrakes

*Attorney, Agent, or Firm*—Herbert L. Lerner; Laurence A. Greenberg

[57] ABSTRACT

A compressed gas splicing head assembly in an automatic splicing device for producing a knot-free thread connection by splicing, includes a compressed gas splicing head having a splicing channel with two ends formed therein defining a plane of symmetry in longitudinal direction of the splicing channel, the splicing head having outlets for the splicing channel formed therein, and the splicing head having at least two compressed gas injection openings formed therein discharging in said splicing channel mutually opposite and offset to the left and right of the plane of symmetry for holding and mutually tangling, bunching, swirling and winding fibers of two threads to be interconnected, said injection openings including an injection opening disposed closest to a given portion of each respective outlet, and thread and air guides each disposed at a respective one of the ends of the splicing channel, each of the guides obstructing a respective one of the given portions of the outlets, and the threads being disposed between at least two of the compressed air injection openings.

2 Claims, 2 Drawing Figures

COMPRESSED GAS SPLICING HEAD

Figure 1:
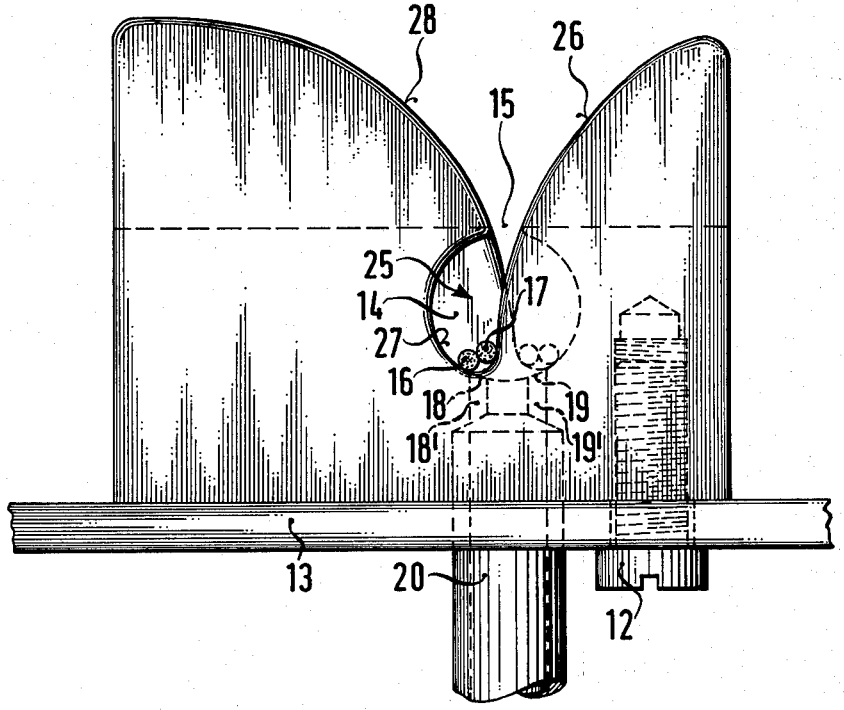

The invention relates to a compressed gas splicing head in an automatic splicing device for producing a knot-free thread connection by splicing, the splicing head having at least two compressed gas injection openings for holding two threads to be interconnected and for permitting mutual tangling, bunching, swirling and/or winding around of the fibers of the threads.

Thread splicing devices which operate with compressed air are known, for example, from German Published, Non-Prosecuted application DE-OS 27 50 913, corresponding to U.S. Pat. No. 4,217,749. However, the possible applications of the conventional thread splicing devices have been limited. Dependent on the fiber material, fiber length, fiber diameter and other fiber properties, splice connections are produced which have very inconsistent appearances, very different strength, and quite varying dimensions.

It is accordingly an object of the invention to provide a compressed gas splicing head, which overcomes the hereinaforementioned disadvantages of the heretofore-known devices of this general type, and which provides a universally applicable splicing head, that is capable of producing splicing connections which are stronger, better looking and more durable than those which were possible until now. Furthermore the reliability of obtaining such a high quality splice connection in a single splicing operation without repetition, should be increased.

With the foregoing and other objects in view there is provided, in accordance with the invention, a compressed gas splicing head assembly in an automatic splicing device for producing a knot-free thread connection by splicing, comprising a compressed gas splicing head having a splicing channel with two ends formed therein defining a plane of symmetry in longitudinal direction of the splicing channel, the splicing head having outlets for the splicing channel formed therein, and the splicing head having at least two compressed gas injection openings formed therein discharging in the splicing channel mutually opposite and offset to the left and right of the plane of symmetry for holding the threads and mutually tangling, bunching, swirling and/or winding fibers of two threads to be interconnected, the injection openings including an injection opening disposed closest to a given portion of each respective outlet, and thread and air guides each disposed at a respective one of the ends of the splicing channel, covering the ends of the splicing channel in such a way that each of the guides obstruct a respective one of the given portions of the outlets, and the threads being disposed between at least two of the compressed air injection openings.

In accordance with a concomitant feature of the invention, the thread and air guides are in the form of plates connected to the splicing head and having thread guiding edges formed thereon.

The advantages achieved by using the invention are in particular the fact that the splicing connection as a rule exhibits greater strength and a better appearance than with previous methods, even after the first splicing attempt and without repetition. This can be achieved with a compact splicing head which can be easily manufactured at low cost. The quality of the splice connection does not vary as with previous devices. The individual fibers are more intimately connected and more uniformly mixed, and stronger bunching and swirling of the fibers is achieved. These advantages are mainly caused by the special form and location of the proposed thread and air guiding means.

Other features which are considered as characteristic for the invention are set forth in the appended claims.

Although the invention is illustrated and described herein as embodied in a compressed gas splicing head, it is nevertheless not intended to be limited to the details shown, since various modifications and structural changes may be made therein without departing from the spirit of the invention and within the scope and range of equivalents of the claims.

Figure 2:
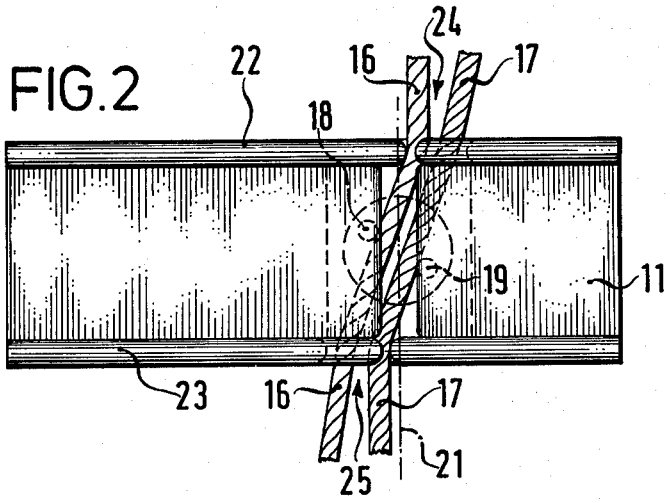

The construction and method of operation of the invention, however, together with additional objects and advantages thereof will be best understood from the following description of specific embodiments when read in connection with the accompanying drawings, in which:

FIG. 1 is a fragmentary, diagrammatic, side elevational view of the compressed gas splicing head of the invention; and FIG. 2 is a top plan view of the compressed gas splicing head of FIG. 1.

Referring now to the figures of the drawing in detail, there is seen a compressed gas splicing head 11 of an automatic splicing device which is not further illustrated. The splicing head is constructed in the form of a compact block, formed of metal. The compressed-gas splicing head is fastened to a plate 13 of the above-mentioned automatic splicing device by means of a screw 12. The splicing head 11 is provided with a splicing channel 14 having a circular cross section. The splicing channel 14 includes an insertion slot 15 on the top thereof for two threads 16, 17 which are to be spliced.

The splicing channel 14 has two compressed gas injection or blast openings 18, 19. The compressed gas injection opening 18 lies at the end of a compressed gas channel 18', and the compressed gas injection opening 19 lies at the end of a compressed gas channel 19'. The two compressed gas channels 18', 19' are supplied with compressed air during the splicing operation.

The two compressed gas injection openings 18 and 19 discharge in the splicing channel 14 opposite each other and offset or staggered to the left and to the right from a plane of symmetry 21 lying along the splicing channel 14. The openings 18 and 19 are spaced apart from each other by a distance which is approximately $\frac{3}{4}$ of the diameter of the splicing channel 14.

Respective thread and air guiding means 22, 23 are disposed at two ends of the splicing channel 14. These thread and air guiding means cover the ends of the splicing channel 14 asymmetrically, in such a manner that only a part of the ends, in particular only about half of each of two outlets 24 and 25 of the splicing channel, remain free. The thread and air guiding means 22, 23 are formed of plates which are connected to the splicing head 11, and are provided with thread guiding edges. The plates are formed of metal in this embodiment, but they could also be formed of a wear-resistant plastic or a ceramic material. The plates are cemented to the splicing head. However, any other suitable fastening method may be used. A fastening which permits a position change or adjustment with respect to the splicing channel 14, should be given special consideration. FIG. 1 shows the above-mentioned thread guiding edges 26, 27 and 28 of the thread and air guiding means 23. All three thread guiding edges blend smoothly into each other.

The thread guiding edge 26 has a curved contour. The edge 26 extends approximately to the bottom of the outlet 25, and blends at that location into the thread guiding edge 27 which follows the round shape of the splicing channel 14. At the height of the insertion slot 15, the thread guiding edge 27 blends and continues into the thread guiding edge 28 which also has a curved contour. The two thread guiding edges 26 and 28 lie opposite each other in the outer region, and form a funnel-shaped opening at the outer region, which facilitates the insertion of the threads which are to be spliced.

The other thread and air guiding means 22 is constructed and disposed as a mirror image of the thread and air guiding means 23, which is also indicated in the drawings. All thread guiding edges are rounded and smoothed, so that no fibers will adhere to them.

FIG. 1 especially shows that the threads 16, 17 to be spliced are easily guided by the thread guiding edges 26, 28 and inserted into the splicing channel 14 through the insertion slot 15, so that they finally rest at the lower part of the splicing channel. In the interior of the compressed gas splicing head 11, the thread runs obliquely through the splicing channel 14, in the manner shown in FIG. 2 and therefore the compressed gas injection opening 18 discharges in the splicing channel 14 to the left, and the compressed gas injection opening 19 discharges to the right, of the closely adjacent threads.

During the splicing operation which follows, the compressed gas injection openings disposed according to the invention produce two air swirls or turbulences directed opposite to each other. The lateral discharge of the air is guided and partly obstructed, the threads lie obliquely below the insertion slot 15, and all together the desired and expected excellent splicing results are produced.

The invention is not limited to the typical embodiment which is shown and described.

For example, the compressed gas splicing head could also be made of another material instead of metal, such as a sintered metal, a ceramic material, or the like. The mutual spacing of the compressed gas injection openings depends mainly on the thread size. The thread and air guide means could also be differently constructed as an alternative. For example, they could be unilateral, so that only the thread guiding edge 26 extends down to the plate 13, and the other two thread guiding edges are omitted. It is also advantageous to let the compressed gas injection openings discharge tangentially into the splicing channel.

The foregoing is a description corresponding in substance to German application P 32 15 423.2, dated Apr. 24, 1982, the International priority of which is being claimed for the instant application, and which is hereby made part of this application. Any material discrepancies between the foregoing specification and the aforementioned corresponding German application are to be resolved in favor of the latter.

We claim:

1. Compressed gas splicing head assembly in an automatic splicing device for producing a knot-free thread connection by splicing, comprising a compressed gas splicing head having a splicing channel with two ends formed therein defining a plane of symmetry in longitudinal direction of said splicing channel, said splicing head having outlets for said splicing channel formed therein, and said splicing head having at least two compressed gas injection openings formed therein discharging in said splicing channel mutually opposite and offset to the left and right of said plane of symmetry for holding and mutually tangling, bunching, swirling and winding fibers of two threads to be interconnected, said injection openings including an injection opening disposed closest to a given portion of each respective outlet, and thread and air guides each disposed at a respective one of said ends of said splicing channel, each of said guides obstructing a respective one of said given portions of said outlets, and said threads being disposed between at least two of said compressed air injection openings.

2. Compressed gas splicing head assembly according to claim 1, wherein said thread and air guides are in the form of plates connected to said splicing head and having thread guiding edges formed thereon.

* * * * *